United States Patent [19]

Armstrong et al.

[11] Patent Number: 4,814,555

[45] Date of Patent: Mar. 21, 1989

[54] ROTARY SWITCH HAVING A FLUX CONTROLLING STRUCTURE

[76] Inventors: L. Lamar Armstrong; Peter A. Medicks, both of P.O. Box 860, 525 Truck Ln., Smithfield, N.C. 27577

[21] Appl. No.: 170,898

[22] Filed: Mar. 21, 1988

[51] Int. Cl.[4] ..... H01H 9/30; H01H 19/58; H01H 21/76

[52] U.S. Cl. ..... 200/11 R; 200/11 A

[58] Field of Search ..... 200/11 R, 11 A, 11 D, 200/11 DA, 11 G, 11 J, 11 K, 11 TW, 237, 238, 284, 10, 144 R

[56] References Cited

U.S. PATENT DOCUMENTS 3,119,906 1/1964 Mason ..... 200/11 A 3,297,836 1/1967 OMalley ..... 200/11 A 3,590,174 6/1971 Williams III ..... 200/11 R X 3,668,338 6/1972 O'Malley ..... 200/11 A

*Primary Examiner*—J. R. Scott

*Attorney, Agent, or Firm*—Rhodes, Coats & Bennett

[57] ABSTRACT

A rotary switch is disclosed having an integral mechanical structure for controlling internal contamination from soldering flux residue introduced during switch wiring process. The rotary switch includes an internal collector plate having an input terminal extending to the outside through the switch housing for a solder type input wire. The collector plate includes a mechanical flux controlling structure to restrict and/or trap the excess of the solder flux residue to an electrically neutral area of the switch.

17 Claims, 1 Drawing Sheet

ROTARY SWITCH HAVING A FLUX CONTROLLING STRUCTURE

FIELD OF THE INVENTION

The present invention relates generally to switching devices and more particularly to rotary switches.

BACKGROUND OF THE INVENTION

In connecting a rotary switch into a circuit, lead wires are typically connected to the terminals by crimping the wire around the terminal and then securing the wire with solder. In order to apply the solder to the joint, the terminal and wire are heated using a soldering iron and then the solder is brought into contact with the heated terminal. The heat retained by the terminal causes the solder to change into a liquid state and enables the solder to flow into cracks forming the joint. Flux is typically used during the soldering process to facilitate the flowing of the solder. When excess flux is used, a residue from the soldering process flows along the surface of the terminal and can enter the switch causing open circuit condition, namely, interruption of electrical current flow. In particular, the flux residue can develop as a thin resistive film on the surface of the collector plate within the switch. Because flux compounds are current limiting, traces of flux within the contacting area can render the switch inoperative.

Efforts have been made to avoid contamination of the switch internal parts by flux residues. This is typically accomplished by applying silicon or other sealing compounds to the openings in the switch housing through which the terminals extend. Gaskets have also been used between sections of the switch housing to form a seal. These methods of sealing the housing, however, increase the cost of the switch by added assembly labor, material and parts thus complicating manufacturing process.

SUMMARY AND OBJECTS OF THE INVENTION

The present invention overcomes the disadvantages of the prior art by adding means to the rotary switch to prevent flux entry during soldering process. The present invention is a modification to the collector part of the switch which can be formed by means of the stamping die, which simplifies manufacturing by reducing cost of materials and associated labor.

The switch of the present invention includes a switch housing that encloses the current carrying components of the switch. A collector plate is secured within the housing and includes an input terminal which extends from one or more openings in the switch housing to the outside. It is through these openings that flux residue can enter the switch housing and spread over internal collector surfaces. A plurality of fixed contacts are also secured within the housing in spaced relationship to the collector plate. A rotor with movable contacts is disposed between the collector plate and the fixed contact for directing current between the collector plate and any one or more of the fixed contacts.

In order to protect the integrity of the active part of the collector, the two following features are therefor incorporated:

(1) A flow restrictor - trap, consisting of an opening at the base of each input terminal and next to the collector plate. This opening effectively narrows the path and provides a void area or trap for the excess flux to gather.

(2) A flow director channel, consisting of the groove formed on the surface and adjacent to the base of the input terminal on each plate.

The flow director effectively directs the small amount of flow that may have advanced beyond the flow restrictor to an electrically neutral area of the switch. The outside protruding input terminal, to which the soldered wire connection is made for conducting electrical current to the inner collector part, is therefore isolated by surface restrictions or two stage mechanical barriers. When flux residue encounters both barriers during wiring process, as a consequence, it is contained within safe distance from electrically active collector area.

DETAILED DESCRIPTION OF THE INVENTION

Figure 1:
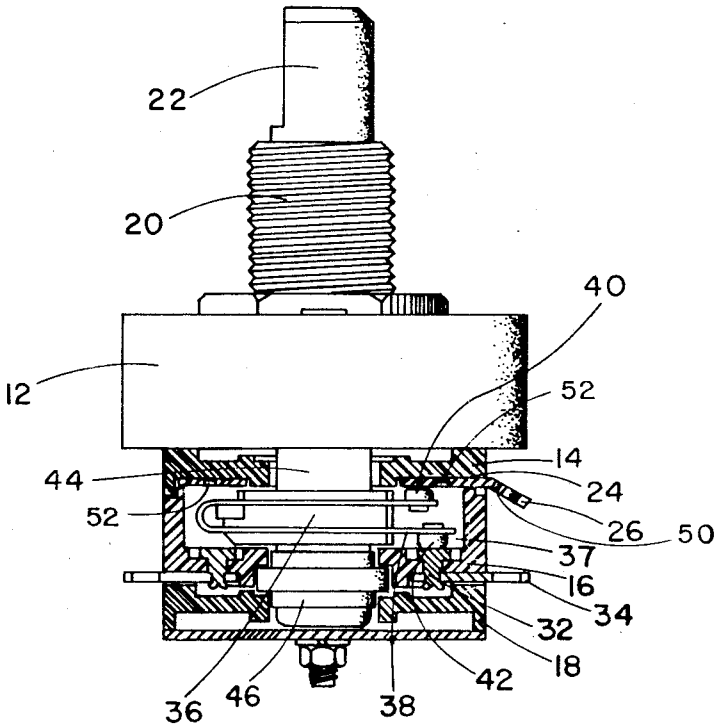
FIG. 1 is an elevation of a rotary switch embodying the present invention with a quarter-section of the switch housing removed.

Referring now to FIG. 1, a rotary switch, generally designated 10, embodying the present invention is illustrated. Switch 10 includes a switch housing comprising housing sections 12, 14, 16 and 18, an externally threaded bushing 20 mounted on top of housing section 12, and a shaft 22 journaled within bushing 20. Housing section 12 contains a detent mechanism (not shown) for stationing shaft 22 at incremental angles of rotation which coincide with the operating positions of the switch 10. Since detent mechanisms are of many types and known to those skilled in the art, a detailed discussion of the same is omitted.

The current carrying components of the switch 10 are housed within housing sections 14, 16 and 18. A collector plate 24 including an input terminal 26 is assembled into a recessed area 28 formed in the housing section 14 such that the input terminal 26 projects through opening 30 in the housing section 14. A plurality of circumferentially spaced contacts 32 are embedded in housing section 16 and are connected to output terminals 34. A rotor 36 is disposed within the cavity 37 formed between housing sections 14 and 16. Rotor 36 carries at least one U-shaped rotor contact arm 38 Which has a pair of contacts, 40 and 42, on opposite ends thereof. The rotor contact arm 38 resiliently presses contact 40 against the collector plate 24, while pressing contact 42 against housing section 16 in which the fixed contacts 32 are embedded.

Rotor 36 is connected to shaft 22 by a flat shaft 44 which has one end secured within a slot (not shown) in the end of round shaft 22 and the opposite end secured within a nylon bushing 46. The flat shaft 44 extends through a slotted opening 47 formed in the rotor 36. Thus, the round shaft 22, flat shaft 44 and rotor 36 all rotate as a unitary assembly.

As rotor 36 is turned, contact 40 remains in contact with the collector plate 24 irrespective of the angular position of rotor 36, while contact 42 sequentially engages the fixed contacts 32 in housing section 16. Each time a fixed contact 32 is engaged, an electrical connection is established between that contact 32 and the collector plate 24 through the electrically conductive rotor contact arm 38.

A problem with prior art switches of the type described herein occurs when an input wire is connected to the input terminal 26 by using flux to facilitate adherance of the solder within joint. When poor soldering methods are used the excess flux flows along the input terminal 26 through the opening 30 and into the switch housing where it disperses without restriction on the collector plate 24. Because the flux is current limiting, traces of flux on the collector plate 24 can prevent the flow of current between the collector plate 24 and contact 40, thus rendering the switch inoperative.

Figure 2:
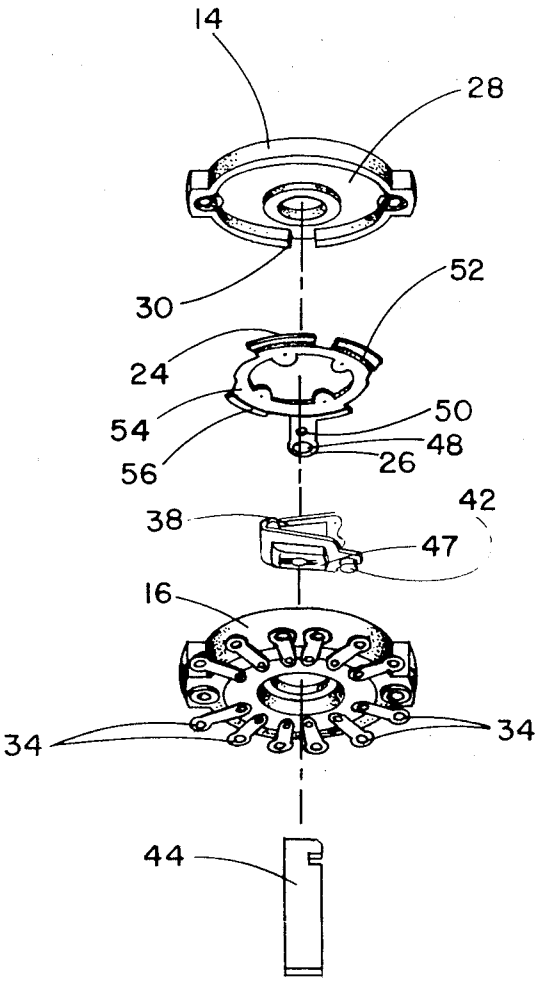
FIG. 2 is an exploded perspective illustrating the current carrying components of the rotary switch.

The present invention solves the aforementioned problem by means of a specially designed collector plate 24 which is illustrated most clearly in FIG. 2. Referring first to the input terminal 26, the terminal includes openings 48 and 50. The outer opening 48 is used to connect an input wire to the input terminal 26. The input wire is inserted through opening 48 and crimped and soldered. During this soldering process, a flux residue will flow along the input terminal towards the opening 30 in switch housing 14. Opening 50 is interposed in the path of the flux residue flow. This opening so effectively narrows the path of flow and provides a void area or trap for excess flux to gather. Some flux residue, however, will flow around opening 50 and into the switch housing.

In order to further protect the switch 10 and collector plate 24 from flux residue which infiltrates the switch housing, a shallow groove 52 is formed on the surface of the collector plate 24 which divides the collector plate into an inner protected contact area 54. The groove 52 protects the integrity of the switch by impeding the flow of flux residue along the collector plate 24. More particular, when the flux residue reaches groove 52 it is directed by groove 52 along the peripheral area 56 of the collector plate 24. The flux is kept out from inner area 54 by means of the adjacently positioned groove 52.

Only a shallow groove 52 is needed in order to achieve deflection of the flux residue. A groove 52 having a depth of 1/1000 of an inch to 3/1000 of an inch is suitable. The groove may be easily formed by means of a stamping die which simplifies manufacturing.

Though shown in the drawings as a single pole switch, the present invention can be practiced with numerous types of rotary switches including two pole, three pole, four pole and six pole switches. The present invention protects the integrity of the current carrying components of the switch by inhibiting the flow of flux residue without the use of gaskets or sealants.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A rotary switch having integral means for preventing infiltration of flux residue into the contact area of the switch comprising:

(a) a switch housing;

(b) at least one conductive collector plate secured within the switch housing, the collector plate including an inner contact area, an input terminal for connecting an input wire to the collector plate, and a peripheral border area disposed between the input terminal and the contact area;

(c) flow directing means separating the inner contact area and the peripheral area of the collector plate for directing the flow of flux residue entering the switch housing along the input terminal away from the inner contact area of the collector plate and into the peripheral area;

(d) a plurality of fixed contacts secured within the switch housing in spaced relationship with the collector plate;

(e) a plurality of output terminals connected to respective fixed contacts for connecting output wires to the fixed contacts;

(f) a rotor disposed between the collector plate and the fixed contacts for directing current from the contact area of the collector plate to a plurality of the fixed contacts, and (g) means for rotating the rotor to establish an electrical connection between the collector plate and the selected fixed contact.

2. The rotary switch according to claim 1 wherein the rotor means includes a first rotor contact which engages the collector plate within the inner contact area and a second rotor contact which sequentially engages the fixed contacts.

3. The rotary switch according to claim 1 wherein the flow directing means is integrally formed with the collector plate.

4. The rotary switch according to claim 3 wherein the flow directing means comprises a groove formed on the surface of the collector plate.

5. The rotary switch according to claim 1 wherein the input terminal includes a flow restricting means for narrowing the path between the input terminal and the collector plate.

6. The rotary switch according to claim 5 wherein the flow restricting means comprises an opening formed in the input terminal adjacent the collector plate to provide a void for trapping excess flux residue.

7. In a rotary switch including at least one collector plate having an input terminal extending from the perimeter thereof, a plurality of fixed contacts in spaced relationship to the collector plate, and rotor means for directing current between the collector plate and the fixed contacts, the improvement comprising: flow directing means integrally formed on the surface of the collector plate and dividing the collector plate into an inner protected contact area and a peripheral area for directing the flow of current limiting material away from the contact area of the collector plate and into the peripheral area.

8. The rotary switch according to claim 7 wherein the flow directing means comprises a groove formed in the surface of the collector plate.

9. The rotary switch according to claim 8 wherein the first rotor means includes a first rotor contact which engages the collector plate within the inner protected contact area and a second rotor contact which sequentially engages the fixed contacts.

10. The rotary switch according to claim 8 wherein the input terminal includes a first opening for connecting an input wire to the collector terminal and a second opening disposed between the first opening and the peripheral area of the collector plate for accumulating flux residue.

11. A method for protecting the integrity of a rotary switch of the type including a switch housing; at least one collector plate disposed within said housing and having a switch contact area, an input terminal, and a peripheral area lying between the contact area and the input terminal; a plurality of fixed contacts secured within said housing in spaced relationship to the collector plate; and rotor means for directing current between the collector plate and the fixed contacts, the method comprising:

(a) intercepting the flow of flux residue entering the switch housing along the input terminal; and (b) directing the flow of flux residue away from the contact area of the collector plate and along the peripheral area thereof.

12. The method according to claim 11 wherein the step of directing flux residue along the peripheral area of the collector plate includes forming a groove on the surface of the collector plate between the contact area and the peripheral area.

13. In a multi-position switch having a housing; a collector plate having an input terminal, switch contact area, and a peripheral area laying between the input terminal and the switch contact area; and a switch assembly having a series of output terminals and a movable switch connector engaged with the switch contact area of the collector plate and movable therealong for directing current from the collector plate to the output terminals, the improvement comprising: means formed on the collector plate between the input terminal and the switch contact area for directing flux flowing from the input terminal away from the switch contact area and along the peripheral area of the collector plate.

14. The switch according to claim 13 wherein the flow directing means is integrally formed with the collector plate.

15. The switch according to claim 14 wherein the flow directing means is a groove formed on the surface of the collector plate.

16. The switch according to claim 13 further including flow restricting means for narrowing the path between the input terminal and the collector plate.

17. The switch according to claim 16 wherein the flow restricting means comprises an opening formed in the input terminal adjacent the collector plate to provide a void for trapping excess flux residue.

* * * * *